US012654754B2

(12) United States Patent
Zwolinski

(10) Patent No.: US 12,654,754 B2
(45) Date of Patent: Jun. 16, 2026

(54) TRAIN CONTROL SYSTEMS WITH HAZARD MANAGEMENT AND ASSOCIATED METHODS

(71) Applicant: Siemens Mobility, Inc., New York, NY (US)

(72) Inventor: Peter Zwolinski, Ponte Vedra, FL (US)

(73) Assignee: Siemens Mobility, Inc., New York, NY (US)

( * ) Notice: Subject to any disclaimer, the term of this patent is extended or adjusted under 35 U.S.C. 154(b) by 0 days.

(21) Appl. No.: 18/053,221

(22) Filed: Nov. 7, 2022

(65) Prior Publication Data

US 2024/0149929 A1 May 9, 2024

(51) Int. Cl.
*B61L 23/00* (2006.01)
*B61L 27/70* (2022.01)

(52) U.S. Cl.
CPC ..... *B61L 23/00* (2013.01); *B61L 27/70* (2022.01)

(58) Field of Classification Search
CPC ..... B61L 15/009; B61L 15/0063; B61L 15/0054; B61L 27/20; B61L 27/40; B61L 27/70; B61L 23/00; B61L 23/044
See application file for complete search history.

(56) References Cited

U.S. PATENT DOCUMENTS 5,893,043 A * 4/1999 Moehlenbrink .... B61L 15/0054 701/446
11,014,586 B2 * 5/2021 Pinkerton ..... B61L 27/57
2009/0184210 A1 * 7/2009 Groves, Jr. ..... B61L 27/30 246/3
2009/0210154 A1 * 8/2009 Willis ..... B61L 25/025 701/412
2010/0312461 A1 * 12/2010 Haynie ..... B61L 25/026 701/117
2011/0172856 A1 * 7/2011 Kull ..... B61L 15/0027 246/219
2012/0072088 A1 * 3/2012 Cutright ..... B60T 13/665 701/70
2014/0088802 A1 * 3/2014 Knollmann ..... B61L 15/009 701/19
2014/0277824 A1 * 9/2014 Kernwein ..... B61K 9/08 701/1
2018/0009454 A1 * 1/2018 Katsuragi ..... B61L 25/026
2020/0172133 A1 * 6/2020 Abrosimov ..... B61L 15/0027
2020/0189632 A1 * 6/2020 Saxena ..... B61L 23/007
2021/0107536 A1 * 4/2021 Hania ..... B61L 15/0058
2022/0194443 A1 * 6/2022 Covari ..... H02J 7/14
2022/0379936 A1 * 12/2022 Piparsaniya ..... B61L 15/0063
2024/0043043 A1 * 2/2024 Brooks ..... B60W 60/00256

* cited by examiner

*Primary Examiner* — John Kwon

(57) ABSTRACT

A train control system includes an onboard unit configured to be installed in a locomotive of a train, a back office server system, a hazard management system, and a communication network configured to interface with the onboard unit, the back office server system and the hazard management system, wherein the hazard management system is configured to collect and process hazard related information, and wherein the hazard management system is configured to determine vital and non-vital hazard information based on the hazard related information and to communicate the vital and non-vital information to the onboard unit.

11 Claims, 6 Drawing Sheets

TRAIN CONTROL SYSTEMS WITH HAZARD MANAGEMENT AND ASSOCIATED METHODS

BACKGROUND

1. Field

Aspects of the present disclosure generally relate to railroads and railroad vehicles, e. g. trains, and more particularly to train control systems including hazard management and associated methods.

2. Description of the Related Art

Controlling movement of trains in a modern environment is a complex process. Collisions with other trains must be avoided and regulations in areas such as grade crossings must be complied with. Train control systems such as Positive Train Control, herein referred to as 'PTC', and Automatic Train Control, herein referred to as 'ATC', increase performance of trains and railroads in terms of for example speed, reliability, and safety.

PTC is a system designed to prevent train-to-train collisions, derailments caused by excessive speeds, unauthorized train movements in work zones, and the movement of trains through switches left in the wrong position. PTC networks enable real-time information sharing between trains, rail wayside devices, and 'back office' applications, regarding train movement, speed restrictions, train position and speed, and the state of signal and switch devices.

SUMMARY

Briefly described, one or more embodiments of the present disclosure provide for train control systems, specifically PTC systems, and methods for handling hazard information, including potential and enforceable hazards, utilizing a train control system.

A first aspect of the present disclosure provides a train control system comprising an onboard unit configured to be installed in a locomotive of a train, a back office server system, a hazard management system, and a communication network configured to interface with the onboard unit, the back office server system and the hazard management system, wherein the hazard management system is configured to collect and process hazard related information, and wherein the hazard management system is configured to determine vital and non-vital hazard information based on the hazard related information and to communicate the vital and non-vital information to the onboard unit.

A second aspect of the present disclosure provides a method for handling hazard information, the method comprising collecting hazard related information by a hazard management system of a train control system, determining vital and non-vital hazard information based on the collected hazard related information by the hazard management system, communicating, by the hazard management system, the vital and non-vital hazard information to an onboard unit, the onboard unit being installed in a locomotive of a train, and receiving and processing the vital and non-vital hazard information by the onboard unit during operation of the train.

DETAILED DESCRIPTION

Figure 1:
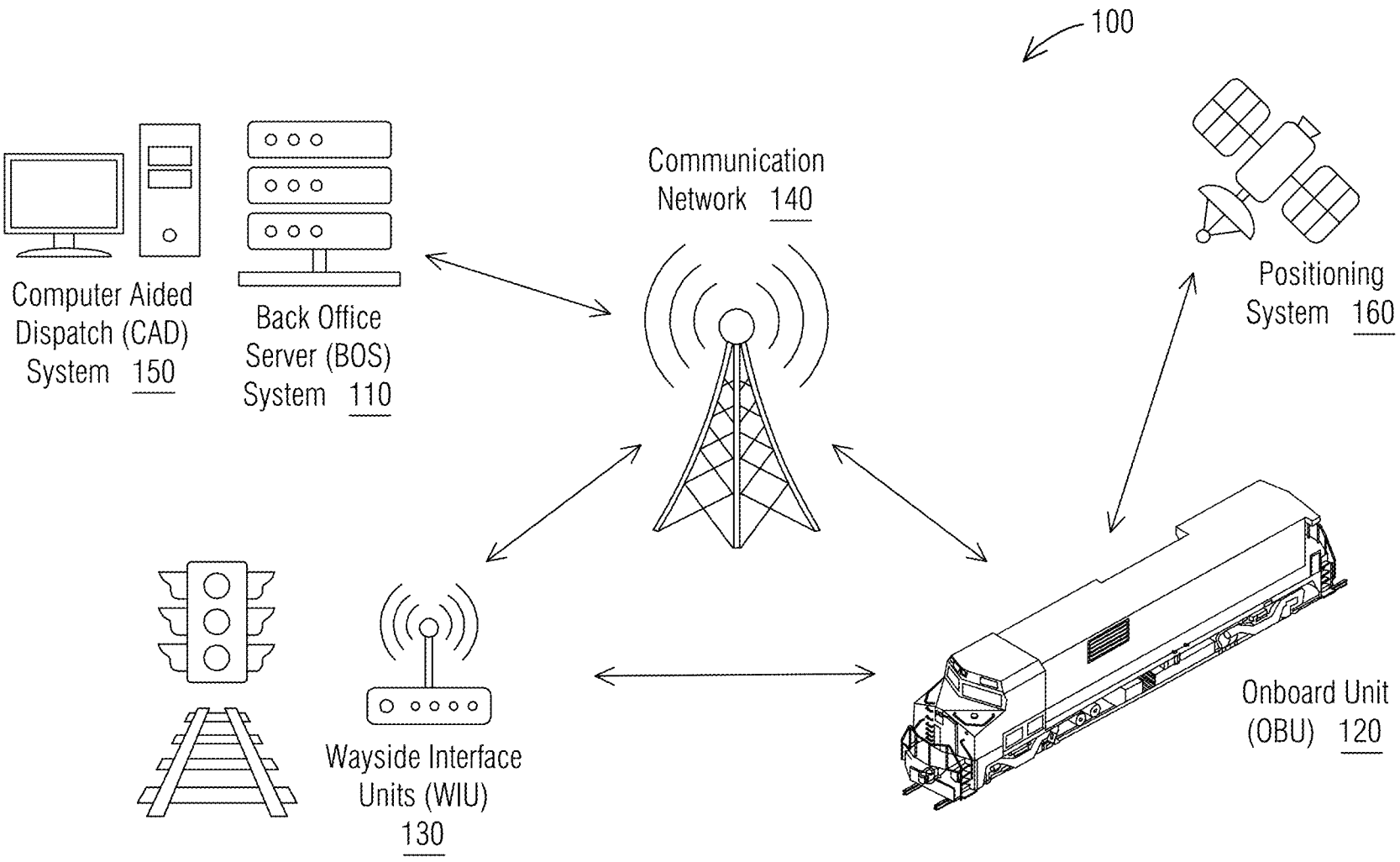
FIG. 1 PRIOR ART
FIG. 1 illustrates a schematic of a known train control system in accordance with an exemplary embodiment of the present disclosure.

To facilitate an understanding of embodiments, principles, and features of the present disclosure, they are explained hereinafter with reference to implementation in illustrative embodiments. In particular, they are described in the context of systems and methods for hazard management in connection with trains.

Various technologies that pertain to systems and methods will now be described with reference to the drawings, where like reference numerals represent like elements throughout. The drawings discussed below, and the various embodiments used to describe the principles of the present disclosure in this disclosure are by way of illustration only and should not be construed in any way to limit the scope of the disclosure.

FIG. 1 illustrates a schematic of a known train control system 100. In an example, the train control system 100 is configured as PTC system. As noted earlier, PTC is a system designed to prevent train-to-train collisions, derailments caused by excessive speeds, unauthorized train movements in work zones, and the movement of trains through switches left in the wrong position.

In general, PTC system 100 comprises back office server system 110, herein also referred to as BOS system 110, an onboard unit 120 installed and operating in a locomotive of a train, herein also referred to as OBU 120, and a system of wayside interface units 130, herein also referred to as WIUs 130. Further, system 100 comprises a communication network 140 configured to interface with the BOS system 110, the OBU 120, and the WIUs 130.

The PTC system 100 enables enable real-time information sharing between the BOS system 110, OBUs 120 of trains, and WIUs 130, regarding train movement, speed restrictions, train position and speed, and the state of signal and switch devices etc.

The BOS system 110 is a storehouse for speed restrictions, track geometry and wayside signaling configuration databases. The BOS system 110 is operably coupled to a computer aided dispatch system 150, herein also referred to as CAD system 150. The CAD system 150 can be integrated in the BOS system 110. The CAD system 150 is configured to display and dispatch information/data, i. e. messages, to other components or sub-systems, such as the BOS system 110. In an example, the CAD system 150 comprises a human-machine-interface (HMI), e. g. computer and screen, and can be configured to display information on the screen, such as information/data collected by the WIUs 130. Further, the CAD system 150 can be configured such that information/data can be entered, for example manually by an operator, for further processing by the CAD system 150 and/or the BOS system 110.

The OBU 120 monitors and controls train movement, for example if train operator (engineer) fails to respond to audible warnings. The OBU 120 is in communication with a positioning system 160 to determine the position of the train. The positioning system 160 can be for example the Global Positioning System, known as GPS, and the OBU 120 can comprise a GPS receiver.

The WIUs 130 are configured to collect and communicate wayside information to the BOS system 110 and/or OBU 120, via communication network 140. Such wayside information can include for example switch positions, signal states etc.

Figure 2:
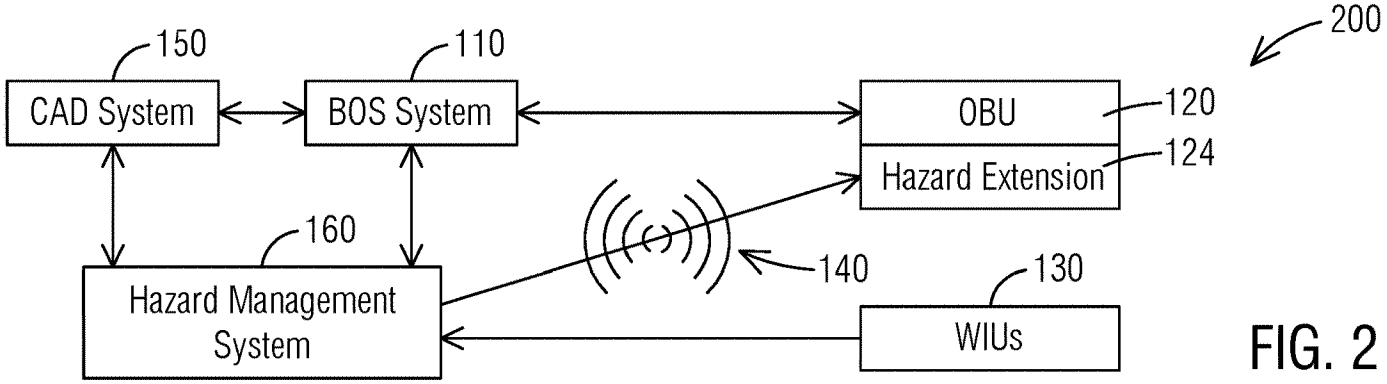
FIG. 2 illustrates a schematic of a first embodiment of a train control system in accordance with an exemplary embodiment of the present disclosure.

FIG. 2 illustrates a schematic of a first embodiment of a train control system 200 in accordance with an exemplary embodiment of the present disclosure. In an example, the train control system 200 is configured as PTC system. Similarly, as described for example with reference to FIG. 1, PTC system 200 comprises BOS system 110, OBU 120, WIUs 130, and communication network 140 configured to interface with the BOS system 110, the OBU 120, and the WIUs 130.

As noted, the WIUs 130 are configured to collect and communicate wayside information to the BOS system 110, via communication network 140. Such wayside information can include for example switch positions, signal states etc. However, the wayside information is for static devices only, since switches, signals and hazard detectors do not move around.

Speed restrictions, also known as Bulletins, and Movement Authorities, herein referred to as 'MA', which are permissions for a train to move from one point to another according to the characteristics of the infrastructure and freedom of the street, are communicated via the BOS system 110 to trains. This information is more dynamic (e.g., movement authorities "move" with the train) but rely on procedures and are not very precise when it comes to the actual location of trains (the train is expected to be within the given MA).

Certain information that is provided to the trains, via OBU 120, is used to ensure safe operations by having the OBU 120 enforce limits and prevent trains enter areas that may contain hazards. For example, an OBU 120 will not allow a train to cross a switch, if the position of the switch cannot be verified safely.

Known systems, such as system 100 of FIG. 1, may have additional information which is currently not sent to the OBUs 120 and therefore cannot be used by the OBU 120 to enhance safety. For example, train positions of relevant, e. g., nearby, trains are not communicated to other trains. Also, in double track territory, trains are not aware of crews working on parallel tracks, e. g., if train is on track 1 and crew works on track 2.

In accordance with an exemplary embodiment of the present disclosure, the system 200 comprises a hazard management system 160 and a hazard extension 124 to enhance the safety of trains and the overall system 200.

The hazard management system 160 is operably coupled with or integrated in the BOS system 110 and/or CAD system 150. The hazard extension 124 is operably coupled with or integrated in the OBU 120. The hazard management system 160 and the hazard extension 124 may be embodied as software or a combination of software and hardware. They may be separate components or may be existing components programmed to perform a function or method as described herein. For example, the hazard management system 160 may be incorporated, for example programmed, into the BOS system 110. Similarly, the hazard extension 124 may be incorporated, for example programmed, into an existing module of the OBU 120.

The hazard management system 160 is configured to collect and process hazard related information, to determine vital and non-vital hazard information based on the hazard related information and to distribute the vital and non-vital information to the OBU 120, via the hazard extension 124 of the OBU 120.

The hazard related information is collected from various sources, the various sources including position reports from multiple OBUs 120 of multiple trains, track circuit occupancy status from track circuits (WIUs 130), health information from level crossings, positioning information from end-of-train units etc. Based on the collected hazard related information, the hazard management system 160 determines vital and non-vital hazard information which is then forwarded or distributed to other sub-systems of the system 200, such as OBUs 120 and CAD system 150.

Vital hazard information comprises enforceable hazards, the vital hazard information being displayed via a display of a human-machine-interface of the OBU 120 and enforced by the OBU 120. In an example, the vital hazard information is handled and processed by the hazard extension 124, or by the OBU 120 utilizing the hazard extension 124.

Enforceable hazards are enforced by the OBU 120 and include for example a brake enforcement because of a stop target, for example to prevent train-to-train collision. A stop target is also referred to as red fence, in reference to the graphic displayed on the OBU 120 for a stop target.

Non-vital hazard information comprises potential hazards, the non-vital hazard information being at least displayed by the OBU 120. The non-vital hazard information is handled and processed by the hazard extension 124 or by the OBU 120 utilizing the hazard extension 124. Potential hazards include for example information to improve situational awareness, such as maintenance crews working on parallel train tracks. Potential hazards are also referred to as yellow fence, in reference to the graphic displayed on the OBU 120.

The vital and non-vital hazard information may be forwarded by the hazard management system 160 to the hazard extension 124 of the OBU 120, via wireless network 140. In another example, the hazard information may be forwarded by the BOS system 110 to the hazard extension 124 of the OBU 120, after the BOS system 110 has received and processed the hazard information from the hazard management system 160.

The CAD system 150 is configured to receive, to process and to display the vital and non-vital hazard information from the hazard management system 160. For example, the CAD system 150 is configured to display the hazard information on a screen or display of a human-machine-interface (HMI), e. g. computer and screen. Further, the CAD system 150 can be configured such that information/data can be entered, for example manually by an operator, for further processing by the CAD system 150 and/or the BOS system 110. Specifically, hazard information may be entered manually via the CAD system 150, such as where and when maintenance crews are present and working, locations of broken rails, etc.

Figure 3:
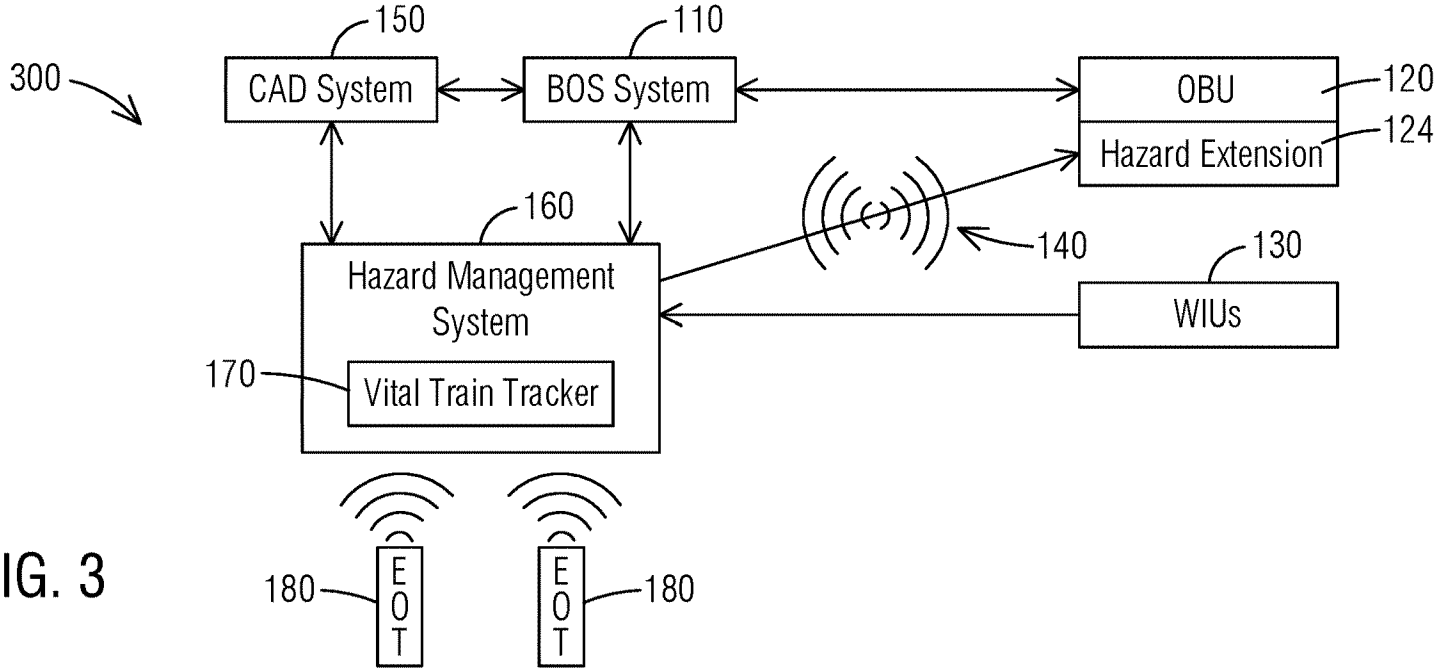
FIG. 3 illustrates a schematic of a second embodiment of a train control system in accordance with an exemplary embodiment of the present disclosure.

FIG. 3 illustrates a schematic of a second embodiment of a train control system 300 in accordance with an exemplary embodiment of the present disclosure. Train control system 300 comprises additional components compared to train control system 200.

In the embodiment of FIG. 3, the system 300, configured as PTC system, comprises a vital train tracker 170. The vital train tracker 170 can be integrated in the hazard management system 160 or can be separate and operably coupled to the hazard management system 160. The vital train tracker 170 is configured to receive and process information specifically from end-of-train devices 180, herein also referred to as EOTs 180.

An EOT 180 is an electronic device which performs several functions, some of which are required by regulations of the Federal Railroad Administration (FRA). The EOT 180 is typically attached at a rear of a last car on a train, often to an unused coupling on an end of the last car opposite a head of the train. Examples of components of the EOT 180 can include cell phone transceivers, systems for monitoring/controlling brake lines and pressure, communication systems for communicating with other units such as for example head of train devices etc. The EOT 180 comprises a tracking device, such as a receiver for a satellite navigation system (see for example system 160 illustrated in FIG. 1), for example a global positioning system (GPS) receiver.

The vital train tracker 170 is configured to receive and process information from the EOTs 180. For example, the EOTs 180 communicate their position via a wireless network. The vital train tracker 170 receives the positioning information of the EOTs 180 and determines that an EOT 180 of a first train ahead of a second train may be considered an enforceable hazard if a distance between the EOT 180 of the first train and the second train is too small and/or the first train stopped moving. In this case, the vital train tracker 170 determines a vital (enforceable) hazard, that is a stop target (red fence). The stop target is communicated/distributed to other relevant OBUs 120 to avoid a collision between trains. Further, the vital train tracker 170 is coupled to the CAD system 150 such that the CAD system 150 receives and displays train information for vitally tracking trains in real-time.

In another embodiment of the present disclosure, the potential and enforceable hazard may be calculated utilizing algorithms, for example machine learning algorithms. Based on for example historical data, train networks, train schedules and maintenance/repair crews, the hazard management system 160 can be configured to calculate potential and enforceable hazards.

Figure 4:
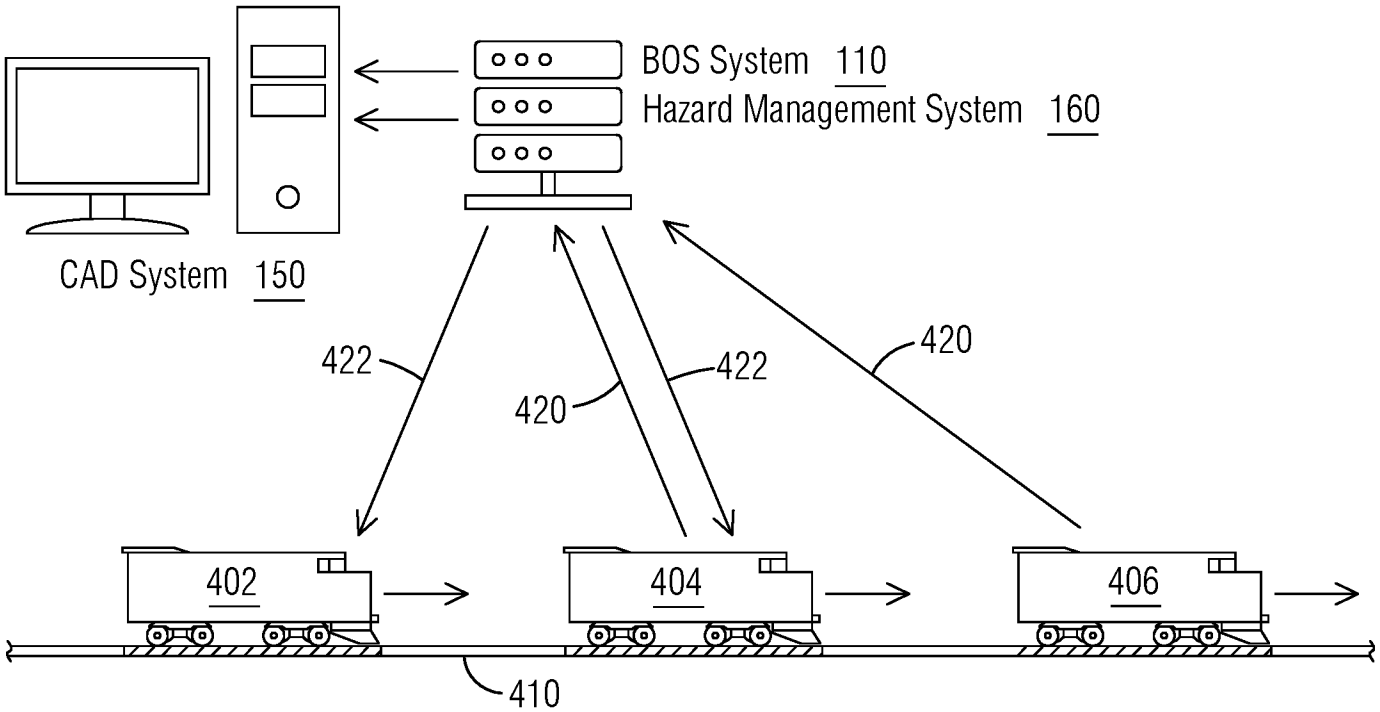
FIG. 4 illustrates a schematic of examples of potential and enforceable hazards in connection with a train control system in accordance with an exemplary embodiment of the present disclosure.

FIG. 4 illustrates a schematic of examples of potential (non-vital) and enforceable (vital) hazards in connection with a train control system in accordance with an exemplary embodiment of the present disclosure.

Multiple trains 402, 404, 406 are travelling on railroad tracks 410 in the same direction, indicated by arrows next to the trains 402, 404, 406. The BOS system 110 receives occupancies and position reports for train tracking from the trains 402, 404, 406 via their respective OBU 120. The occupancies and position reports are used by the CAD system 150 to track and display trains 402, 404, 406.

In an embodiment, the received information (occupancies and position reports) is processed by the hazard management system 160 and sent back to relevant OBUs of nearby trains and displayed as hazards. For example, train 406 communicates, via its OBU, track occupancy and positioning information to the BOS system 110 and hazard management system 160, see communication path 420. The hazard management system 160 receives and processes the information and determines either a potential or enforceable hazard for relevant trains, such as trains 404, 402. The BOS system 110 sends the potential or enforceable hazard information to the OBU of train 404, see communication path 422. In case of a potential hazard, the OBU of train 404 displays a potential hazard (yellow fence). However, if train 406 travels very slowly or stopped moving, the hazard management system 160 determines an enforceable (vital) hazard and sends the enforceable hazard information to the OBU of train 404. The OBU of train 404 then displays a stop target (red fence) and enforces the stop target by stopping the train 404 to prevent collision with train 406. Accordingly, based on position reports and occupancy of train 404, potential and/or enforceable hazard information is sent to OBU of train 402, see communication paths 420, 422.

Figure 5:
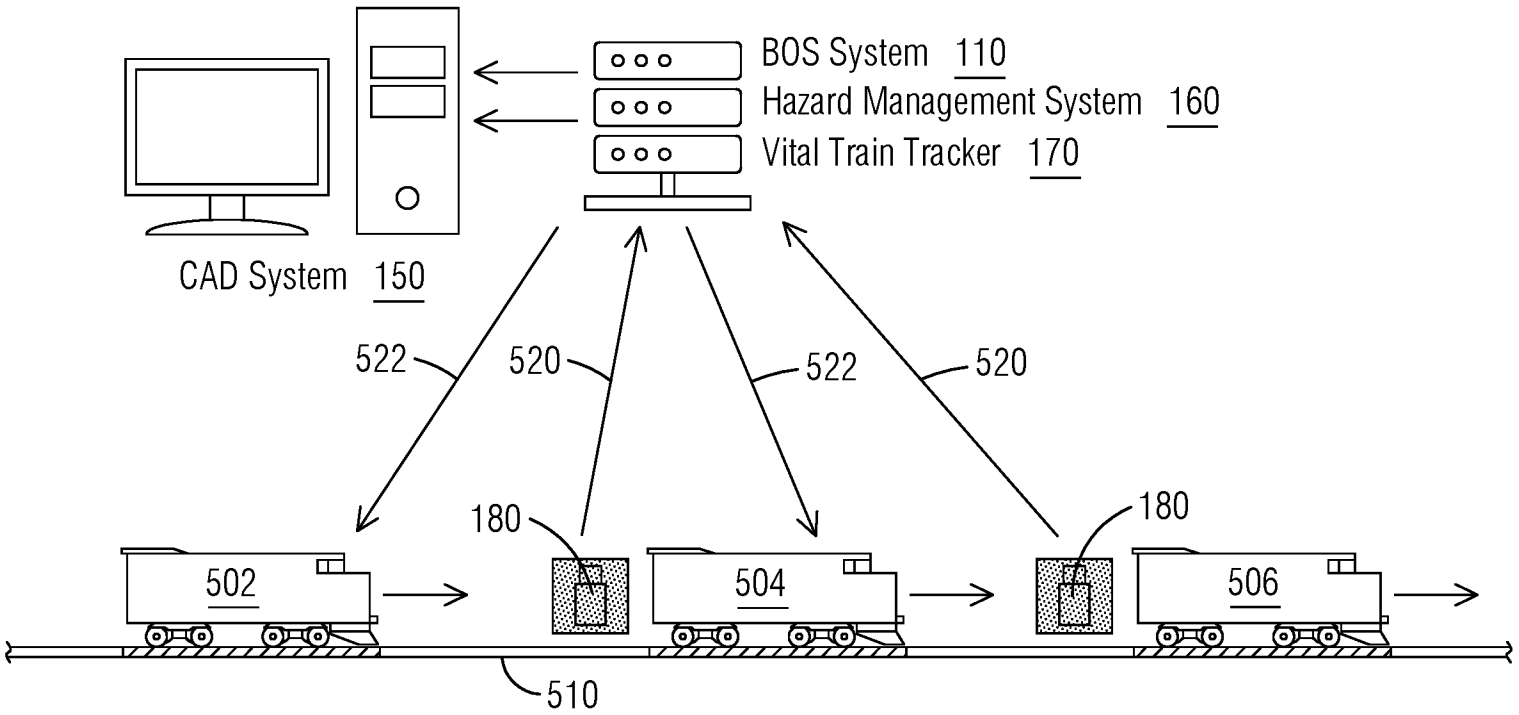
FIG. 5 illustrates a schematic of further examples of enforceable hazards in connection with a vital train tracker of a train control system in accordance with an exemplary embodiment of the present disclosure.

FIG. 5 illustrates a schematic of examples of enforceable (vital) hazards in connection with a vital train tracker of a train control system in accordance with an exemplary embodiment of the present disclosure.

Multiple trains 502, 504, 506 are travelling on railroad tracks 510 in the same direction, indicated by arrows next to the trains 502, 504, 506. The BOS system 110 receives occupancies and position reports for train tracking. The occupancies and position reports are used by the CAD system 150 to track and display the trains 502, 504, 506.

As described earlier with reference to FIG. 3, the train control system may comprise a vital train tracker 170. The vital train tracker 170 can be integrated in the hazard management system 160 or can be separate and operably coupled to the hazard management system 160. In an embodiment, the vital train tracker 170 is configured to receive and process information from EOTs 180.

For example, the EOTs 180 communicate their position and other information via a wireless network, see communication path 520. The vital train tracker 170 (hazard management system 160) receives and processes the information of the EOTs 180. For example, the vital train tracker 170 determines that an EOT 180 of the first train 506 ahead of the second train 504 is an enforceable hazard if a distance between the first train 506 and the second train 504 is too small and/or the first train 506 stopped moving. In this case, the vital train tracker 170 determines a vital hazard, that is a stop target (red fence). The enforceable hazard/stop target is communicated to other trains, specifically train 504 to avoid a collision between trains 506, 504, see communication path 522. Further, based on position reports of the train 504, enforceable hazard information may be sent to the third train 502, for example if second train 504 stops.

In another embodiment, the CAD system 150 is configured for vital train tracking, that means the vital train tracker 170 provides the information received from the EOTs 180 to the CAD system 150 for tracking and displaying.

Figure 6:
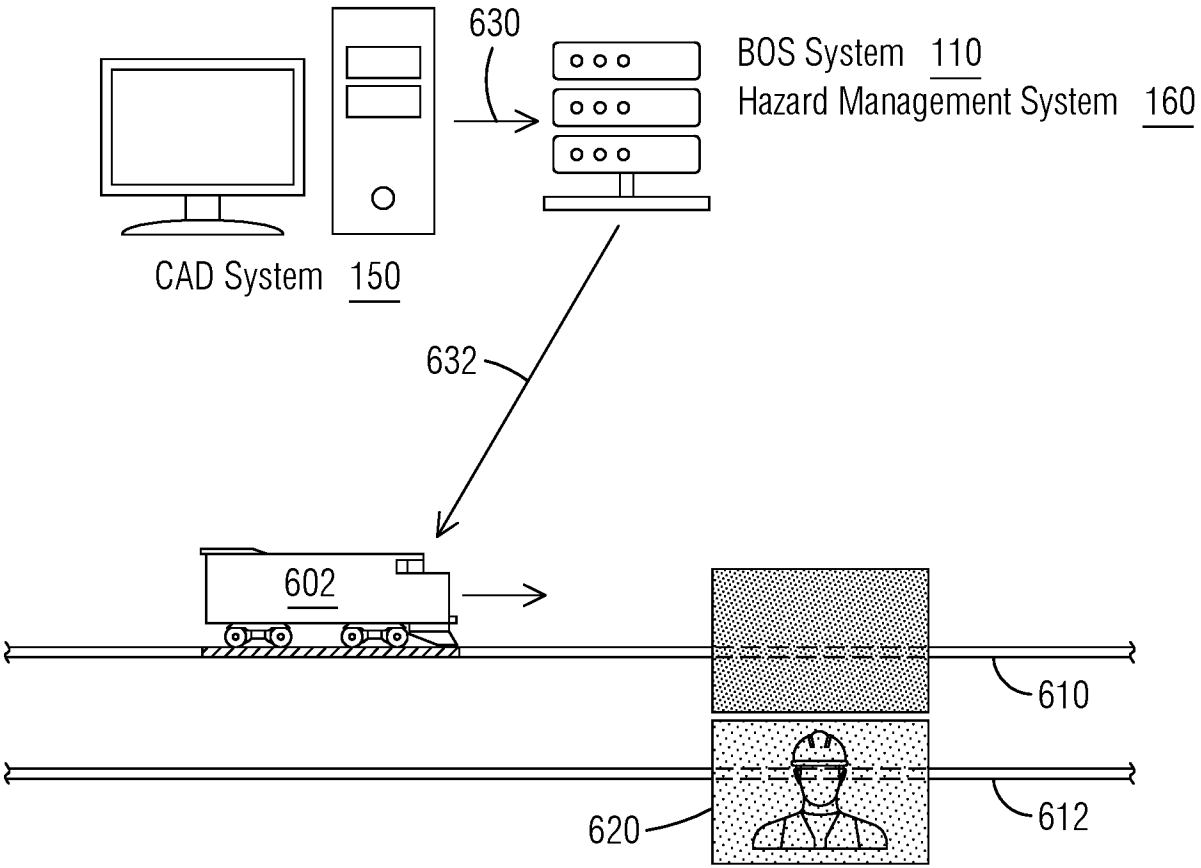
FIG. 6 illustrates a schematic of another example of potential hazards in connection with a train control system in accordance with an exemplary embodiment of the present disclosure.

FIG. 6 illustrates a schematic of another example of potential (non-vital) hazards in connection with a train control system in accordance with an exemplary embodiment of the present disclosure. Train 602 is travelling on railroad track 610. Railroad track 612 is a parallel track adjacent to track 610, and a repair or maintenance crew 620 is working at the parallel railroad track 612.

As described earlier, in an embodiment, the CAD system 150 comprises a human-machine-interface (HMI), e. g. computer and screen, and can be configured such that information/data can be entered, for example manually by an operator, for further processing by the CAD system 150 and/or the BOS system 110. In our example of FIG. 6, information with respect to the crew 620 working on track 612 is entered via the CAD system 150 or directly by the crew in the field, and categorized as a potential hazard and to improve a situational awareness. This information can be entered by an operator who has schedules of crews working on tracks. Then, the information with respect to crew 620 is available for the BOS system 110 and the hazard management system 160, see communication path 630. The BOS system 110 communicates the crew information to OBUs of relevant trains, such as train 602, see communication path 632. In response, the train 602 may slow down while passing the crew 620.

Figure 7:
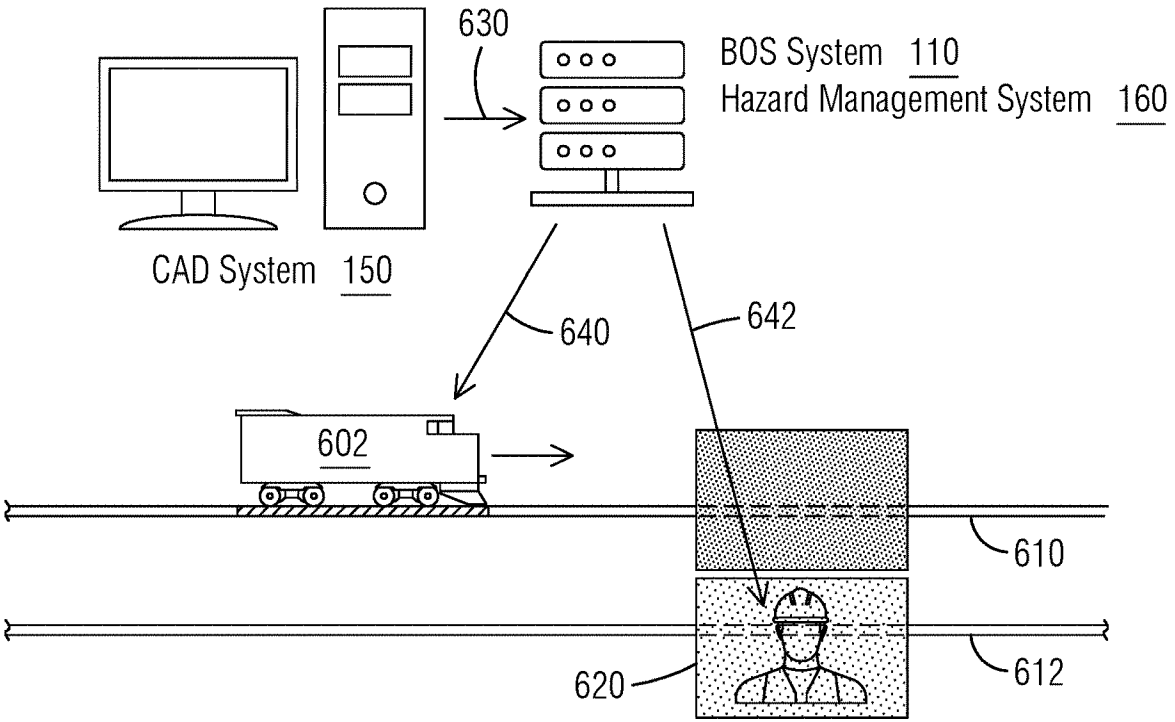
FIG. 7 illustrates a schematic of another example of potential hazards in connection with a train control system in accordance with an exemplary embodiment of the present disclosure.

FIG. 7 illustrates a schematic of another example of potential (non-vital) hazards in connection with a train control system in accordance with an exemplary embodiment of the present disclosure. The example of FIG. 7 is similar to the example of FIG. 6. Train 602 is travelling on the track 610. Railroad track 612 is a parallel track adjacent to track 610, and the repair or maintenance crew 620 is working at the parallel railroad track 612.

In the examples of FIG. 6 and FIG. 7, information with respect to the crew 620 working on track 612 is entered via the CAD system 150 and categorized as a potential hazard and to improve a situational awareness. This information is provided to the BOS system 110 and hazard management system 160, see communication path 630. Further, the train 602, via its OBU, communicates its position and other relevant data to the hazard management system 160, wherein the hazard management system 160 processes and/or combines the position information with the crew information. When train 602 is close to the location of the working crew 620, train approaching warning messages are sent to the members of the crew 620, see communication path 642. For example, the crew members may receive the warning messages on a mobile device, such as mobile phone, tablet etc. within a dedicated application on the mobile device.

Figure 8:
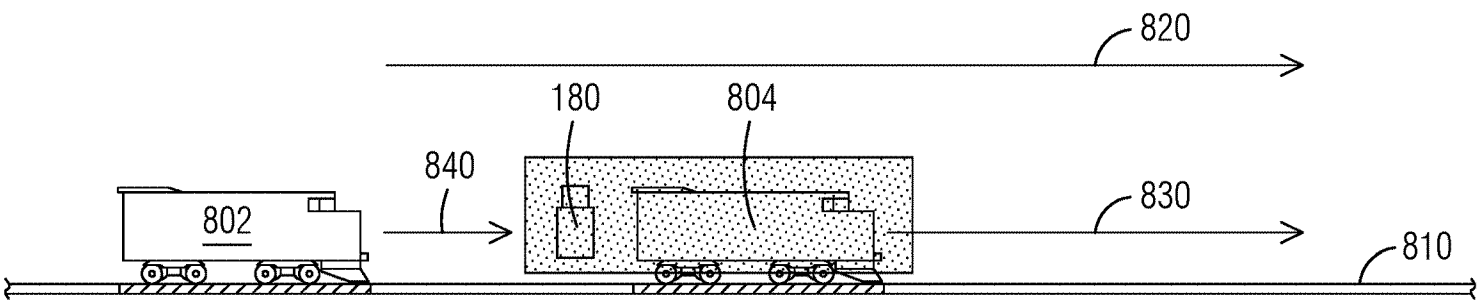
FIG. 8 illustrates a schematic of another example of an enforceable hazard in connection with moving blocks and a train control system in accordance with an exemplary embodiment of the present disclosure.

FIG. 8 illustrates a schematic of another example of an enforceable (vital) hazard in connection with moving blocks and a train control system in accordance with an exemplary embodiment of the present disclosure.

In railway signaling, a moving block is a signaling block system where blocks are defined in real time as safe zones around each train. This requires knowledge of exact locations and speed of all trains at any given time, and continuous communication between the BOS system 110 and the OBUs 120 of the trains. Moving block allows trains to run closer together (reduced headway) while maintaining required safety margins, thereby increasing the track systems overall capacity. The contrast is a fixed block signaling system.

In accordance with an exemplary embodiment of the present disclosure, the train control system 300 including the vital tracker 170 in combination with EOTs 180, see FIG. 3, is configured to execute a moving block method of operation. The moving block method of operation allows movement authorities (MAs) to overlap but red-fencing the train ahead. When the train ahead moves, the red-fence moves with the train (or end-of-train device) and the following train can traverse further.

Specifically with reference to our example in FIG. 8, trains 802 and 804 are travelling in a same direction on track 810. The first train 804 comprises EOT 180. MA 830 was given by the BOS system 110 to the first train 804, and MA 820 was given to the second train 802. When the second train 802 approaches the first train 804, a second, overlapping MA 840, based on data provided by the EOT 180 of the first train 804, can be established for the second train 802. Based on the data of the EOT 180, an enforceable hazard (red fence) can be created, which is communicated to the second train 802. The red fence moves with the train 802, and if necessary, can be acted upon, for example if train 804 slows down or stops.

It should be appreciated that acts associated with the above-described methodologies, features, and functions (other than any described manual acts) may be carried out by one or more data processing systems, such as hazard management system 160, vital train tracker 170 and hazard extension 124 via operation of at least one processor and at least one memory.

The provided systems 200, 300 and associated methods increase safety, as well as reduce cost by removing some existing complexity in the BOS system 110. Further, a dynamic reaction to potential and enforceable hazards can be provided, either by creating a better situational awareness, e. g. displaying potential hazards on OBU 120, or by red-fencing and enforcing hazards via the OBU 120 based on the information provided by the hazard management system 160 and the vital train tracker 170.

New information, for example information transmitted by EOTs 180 or incorrectly operating crossings, can be communicated to trains more easily. The described train control systems 200, 300 and associated methods allow the following, including, but not limited to:

- Propagating train positions to nearby/relevant trains. This includes making sure fouling points are cleared by trains etc., see embodiment of FIG. 4.
- Propagating EOT positions to nearby/relevant trains, see embodiment of FIG. 5.
- Propagating crossing health information to nearby/relevant trains in case of a potential hazardous situation (malfunction of crossing).
- Propagating crew limits to adjacent tracks in double-track/multi-track, see embodiment of FIG. 6.
- Propagating approaching trains to work crews, see embodiment of FIG. 7.
- Propagating broken rail detection findings to nearby/relevant trains.
- Propagating potential hazards that were calculated via algorithms/machine learning to nearby/relevant trains.
- Tracking trains vitally, based on information provided by different systems, e.g., position reports from OBU 120 and position information from EOTs 180, see embodiment of train control system 300 of FIG. 3 including vital train tracker 170. The vital train tracker 170 also allows train length to be verified vitally, for example based on locations of EOT 120 and head of train device (HOT).
- Moving block method of operation, by allowing movement authorities to overlap but red-fencing the train ahead. When the train ahead moves, the red-fence moves with the train (or end-of-train device) and the following train can traverse further, see embodiment of FIG. 8.

The invention claimed is:

1. A train control system comprising:

an onboard unit (OBU) configured to be installed in a locomotive of a train, wherein the OBU comprises a hazard extension, a back office server (BOS) system, a hazard management system, wherein the hazard management system is integrated in the BOS system, a vital train tracker operably coupled to the hazard management system, and a communication network configured to interface with the OBU, the BOS system and the hazard management system, wherein the hazard management system is configured to collect and process hazard related information, and wherein the hazard management system is configured to determine vital and non-vital hazard information based on the hazard related information and to communicate the vital and non-vital information to the hazard extension of the OBU, the hazard extension being configured to receive and process the vital and non-vital hazard information, and wherein the vital train tracker is configured to receive and process information from an end-of-train device attached at a rear of a first train, and wherein the information includes positioning information to determine a vital hazard based on a distance between the first train and a second train, wherein the BOS system is operably coupled to a computer aided dispatch (CAD) system, the CAD system being configured to receive and display the vital and non-vital hazard information from the hazard management system, and wherein the CAD system is configured to receive manually entered hazard information and provide the manually entered hazard information to the hazard management system for further processing.

2. The train control system of claim 1, wherein the hazard management system is configured to collect the hazard related information from various sources, the various sources including position reports from multiple onboard units of multiple trains, track circuit occupancy status from track circuits, health information from level crossings, positioning information from end-of-train units.

3. The train control system of claim 1, wherein the vital hazard information comprises enforceable hazards, the vital hazard information being displayed and enforced by the onboard unit utilizing the hazard extension.

4. The train control system of claim 1, wherein the non-vital hazard information comprises potential hazards, the non-vital hazard information being displayed by the onboard unit.

5. The train control system of claim 1, wherein the train control system is configured as Positive Train Control (PTC) system.

6. A method for handling hazard information, the method comprising:

collecting hazard related information by a hazard management system of a train control system, wherein the hazard management system is integrated in back office server (BOS) system, determining vital and non-vital hazard information based on the collected hazard related information by the hazard management system, communicating, by the hazard management system, the vital and non-vital hazard information to an onboard unit (OBU), the OBU being installed in a locomotive of a train and comprising a hazard extension, receiving and processing the vital and non-vital hazard information by the hazard extension of the OBU during operation of the train, and vitally tracking trains by a vital train tracker, the vital train tracker being configured to collect and process information from an end-of-train device attached at a rear of a first train, wherein the information includes positioning information of the end-of train device to determine a vital hazard based on a distance between the first train and a second train, wherein the BOS system is operably coupled to a computer aided dispatch (CAD) system, the CAD system being configured to receive and display the vital and non-vital hazard information from the hazard management system, and wherein the CAD system is configured to receive manually entered hazard information and provide the manually entered hazard information to the hazard management system for further processing.

7. The method of claim 6, wherein the collecting includes hazard related information from various sources, the various sources including position reports from multiple onboard units of multiple trains, track circuit occupancy status from track circuits, health information from level crossings, positioning information from end-of-train units.

8. The method of claim 6, further comprising:

calculating vital and non-vital hazard information utilizing machine learning algorithms.

9. The method of claim 6, wherein vital hazard information comprises enforceable hazards, the vital hazard information being displayed and enforced by the onboard unit.

10. The method of claim 6, wherein non-vital hazard information comprises potential hazards, the non-vital hazard information being displayed on the onboard unit.

11. The method of claim 6, wherein the train control system is configured as Positive Train Control (PTC) system.

* * * * *